US011448487B1

(12) United States Patent
Morales et al.

(10) Patent No.: US 11,448,487 B1
(45) Date of Patent: Sep. 20, 2022

(54) VIBRATION RESISTANT INITIATOR ASSEMBLY HAVING EXPLODING FOIL INITIATOR

(71) Applicant: Reynolds Systems, Inc., Middletown, CA (US)

(72) Inventors: Emmanuel Morales, Middletown, CA (US); Christopher J. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 17/395,883

(22) Filed: Aug. 6, 2021

Related U.S. Application Data

(60) Provisional application No. 63/067,416, filed on Aug. 19, 2020.

(51) Int. Cl.
*F42B 3/12* (2006.01)

(52) U.S. Cl.
CPC ..... *F42B 3/125* (2013.01); *F42B 3/124* (2013.01)

(58) Field of Classification Search
CPC ..... F42B 3/124; F42B 3/125
USPC ..... 102/202.7
See application file for complete search history.

(56) References Cited

U.S. PATENT DOCUMENTS 7,430,963 B2 10/2008 Hennings et al.
8,408,131 B1 * 4/2013 Nance ..... F42B 3/13 102/202.5
8,485,097 B1 * 7/2013 Nance ..... F42C 19/06 102/202.7
8,726,808 B1 * 5/2014 Nance ..... F42B 3/103 102/202.7
9,038,538 B1 * 5/2015 Nance ..... F42B 3/125 102/202.9
10,267,604 B1 * 4/2019 Morales ..... F42B 3/124
10,267,605 B1 * 4/2019 Meadows ..... F42B 3/12
10,345,084 B1 * 7/2019 Nance ..... F42B 3/125
10,557,692 B1 * 2/2020 Amendola ..... F42B 3/10
10,605,576 B1 3/2020 Nance et al.
10,794,670 B1 10/2020 Nance et al.
11,009,319 B1 * 5/2021 Morales ..... F42B 3/103
2008/0134921 A1 * 6/2008 Nance ..... F42B 3/103 102/202.5
2008/0148982 A1 * 6/2008 Hennings ..... F42B 3/124 102/202.7

(Continued)

OTHER PUBLICATIONS

U.S. Appl. No. 17/011,358, filed Sep. 3, 2020.

*Primary Examiner* — Samir Abdosh
(74) *Attorney, Agent, or Firm* — Burris Law, PLLC

(57) ABSTRACT

An initiator assembly that includes a housing, a base, an exploding foil initiator and an input charge assembly. The housing defines a cavity. The base coupled to the housing and closes the cavity. The exploding foil initiator is mounted to the base and has a barrel that defines an initiation axis. The input charge assembly is received in the cavity and includes a holder and an input charge. The holder has a first axial end and a second axial end that are spaced apart along the initiation axis. The first axial end is closer to an output of the barrel than the second axial end. A charge aperture is formed through the first axial end of the holder and does not extend through the second axial end of the holder. The input charge is formed of an explosive material and is received into the charge aperture.

11 Claims, 5 Drawing Sheets

(56) References Cited

U.S. PATENT DOCUMENTS

| | | | | |
|---|---|---|---|---|
| 2009/0151584 | A1* | 6/2009 | Desai | F42B 3/121<br>102/202.7 |
| 2017/0045342 | A1* | 2/2017 | Fisher | C23C 14/34 |
| 2020/0109927 | A1* | 4/2020 | Amendola | F42B 3/195 |

* cited by examiner

VIBRATION RESISTANT INITIATOR ASSEMBLY HAVING EXPLODING FOIL INITIATOR

CROSS-REFERENCE TO RELATED APPLICATIONS

This application claims the benefit of U.S. Provisional Application No. 63/067,416 filed Aug. 19, 2020, the disclosure of which is incorporated by reference as if fully set forth in detail herein.

FIELD

The present disclosure relates to a vibration resistant initiator assembly having an exploding foil initiator.

BACKGROUND

This section provides background information related to the present disclosure which is not necessarily prior art.

Initiator assemblies are employed to detonate an input charge to release energy that is subsequently employed to initiate detonation, deflagration or combustion in an output charge. There is a trend in the field of initiator assemblies to employ an exploding foil initiator as the means for initiating detonation of the input charge. Electrical energy input to an exploding foil initiator causes a thin metal bridge to vaporize, which propels a flyer through a barrel and into contact with the input charge. The flyer is typically formed of a relatively thin plastic material and must be accelerated over a relatively short distance (i.e., less than 0.050 inch) to a velocity that is sufficient to initiate the detonation of the input charge. Moreover, the flyer must strike the input charge in a manner that is perpendicular to the axis of the barrel to reduce the risk that contact between the flyer and the input charge will initiate detonation of the input charge.

In situations where the initiator assembly is subjected to a relatively large amount of vibration, there is a risk that portions of the output charge will break apart and migrate within the initiator assembly onto the flyer. This situation is detrimental because it greatly increases the risk that the exploding foil initiator will not be able to detonate the input charge. In this regard, if even a relatively small mass of the material that forms the output charge falls onto the flyer, the additional mass could prevent the flyer from being accelerated to a threshold velocity that is needed to cause the input charge to detonate and/or could cause the flyer to tilt relative to the longitudinal axis of the barrel so that the shock produced by contact between the flyer and the input charge is distributed over time (rather than all at once) so that the input charge is not shocked to a degree that initiates detonation of the input charge.

SUMMARY

This section provides a general summary of the disclosure, and is not a comprehensive disclosure of its full scope or all of its features.

In one form, the present disclosure provides an initiator assembly that includes a housing, a base, an exploding foil initiator and an input charge assembly. The housing defines a cavity. The base coupled to the housing and closes the cavity. The exploding foil initiator is mounted to the base and has a barrel that defines an initiation axis. The input charge assembly is received in the cavity and includes a holder and an input charge. The holder has a first axial end and a second axial end that are spaced apart along the initiation axis. The first axial end is closer to an output of the barrel than the second axial end. A charge aperture is formed through the first axial end of the holder and does not extend through the second axial end of the holder. The input charge is formed of an explosive material and is received into the charge aperture.

In another form, the present disclosure provides an initiator assembly that includes a housing, an output charge, an input charge assembly, and a base/EFI assembly. The housing has a housing member and a cover. The housing member has a first axial end and a second axial end and defines a cavity with a first cavity portion, a second cavity portion and a third cavity portion. The first cavity portion extends through the first axial end of the housing member. The third cavity portion extends through the second axial end of the housing member. The second cavity portion is disposed between the first and third cavity portions. The first cavity is larger in diameter than the second cavity portion so as to define a first annular shoulder on the housing member where the first and second cavity portions intersect one another. The second cavity portion is larger in diameter than the third cavity portion so as to define a second annular shoulder on the housing member where the second and third cavity portions intersect one another. The cover is fixedly coupled to the second axial end of the housing member to close an end of the cavity. The output charge is received in the third cavity portion and is at least partly formed of an explosive material. The input charge assembly has a holder and an input charge. The holder is fixedly coupled to the housing member and has a first holder portion and a second holder portion. The first holder portion defines a charge aperture that does not extend fully through the holder. The second holder portion is smaller in diameter than the first holder portion. A third annular shoulder is formed on the holder radially outwardly of where the second holder portion intersects the first holder portion. The first holder portion is received into the second cavity portion and is located along the initiation axis such that the third annular shoulder is spaced apart from the second annular shoulder on the housing member. The second holder portion is partly received in the third cavity portion. The input charge is received into the charge aperture and is formed of an explosive material. The base/EFI assembly has a base, a plurality of terminals, and an exploding foil initiator. The base is fixedly coupled to the housing member. The terminals extend through the base and are electrically coupled to the exploding foil initiator. The exploding foil initiator is coupled to the base. The base/EFI assembly is slidably received into the first cavity portion and closes the cavity on a side of the housing member opposite the cover. The base/EFI assembly is abutted against either an axial end of the holder or a barrier that is abutted against the axial end of the holder.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
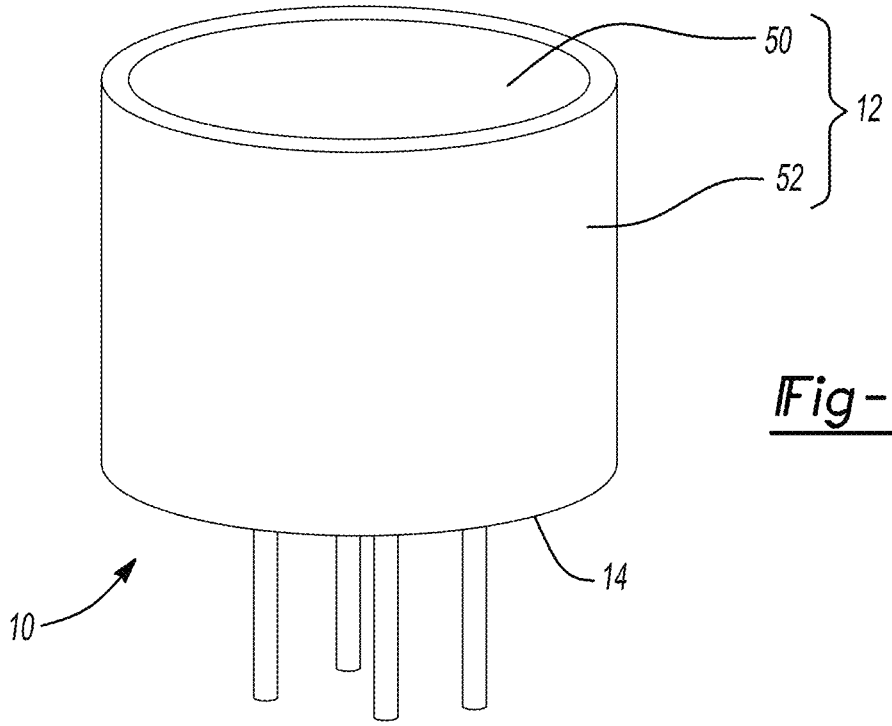
FIG. 1 is a perspective view of an exemplary vibration resistant initiator assembly constructed in accordance with the teachings of the present disclosure.
Figure 2:
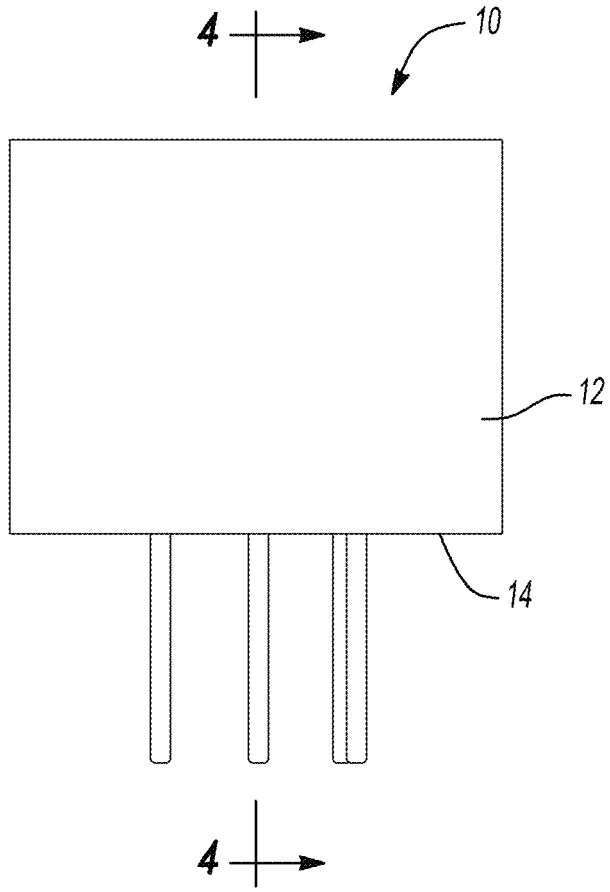
FIG. 2 is a side view of the initiator assembly of FIG. 1.
Figure 3:
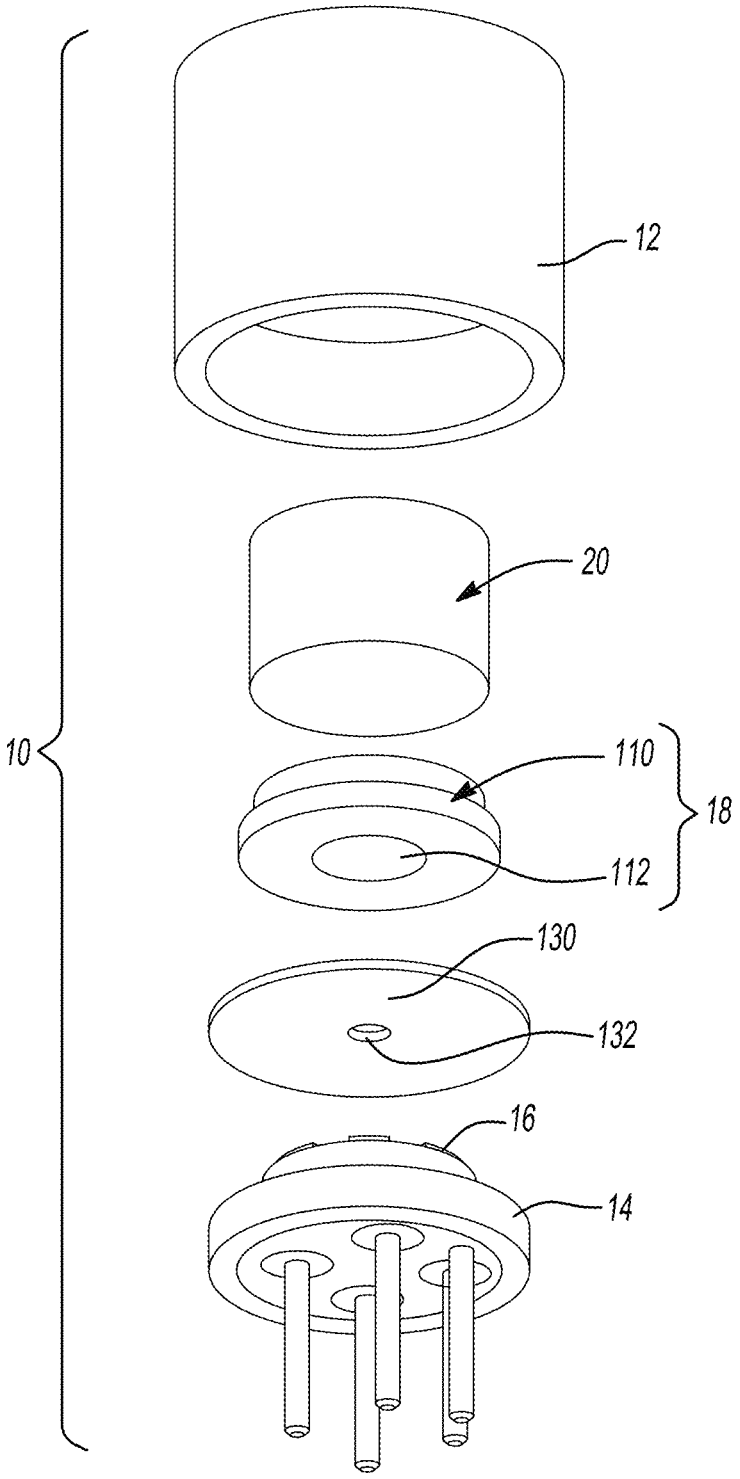
FIG. 3 is an exploded perspective view of the initiator assembly of FIG. 1.

With reference to FIGS. 1 through 3, an initiator assembly constructed in accordance with the teachings of the present disclosure is generally indicated by reference numeral 10. The initiator assembly 10 can include a housing 12, a base 14, an exploding foil initiator 16, an input charge assembly 18, and optionally an output charge 20.

Figure 4:
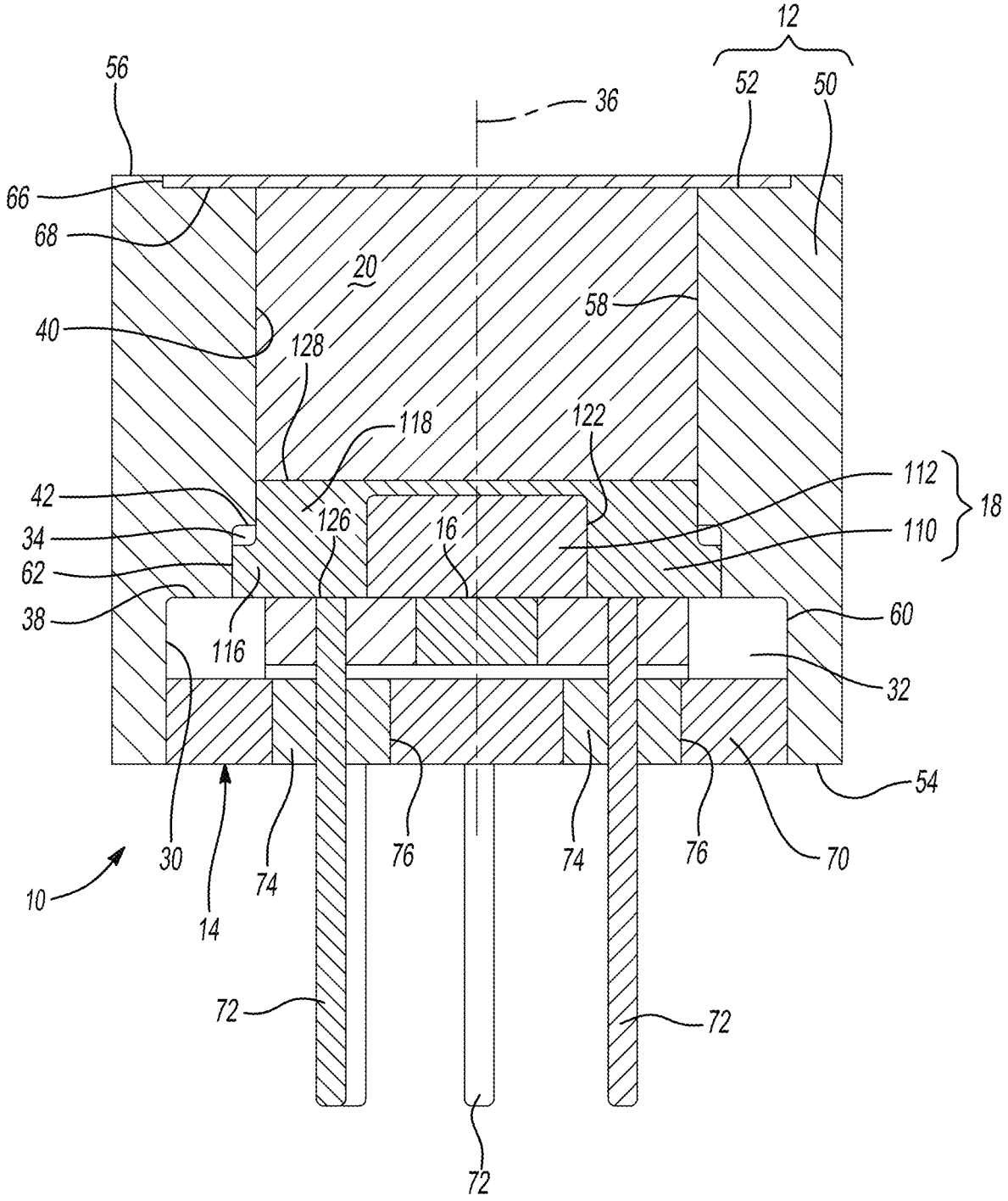
FIG. 4 is a section view taken along the line 4-4 of FIG. 2.

With reference to FIG. 4, the housing 12 can define a cavity 30 that can be configured to receive all or a portion of the base 14, as well as the exploding foil initiator 16, the input charge assembly 18 and if included, the output charge 20. The cavity 30 can have a first cavity portion 32 and a second cavity portion 34 that can be disposed concentrically along an initiation axis 36. The first cavity portion 32 can be larger in diameter than the second cavity portion 34. A first annular shoulder 38 can be formed on the housing 12 where the first and second cavity portions 32 and 34 of the cavity 30 intersect one another. Optionally, the housing 12 can further define a third cavity portion 40 that can be sized to house the output charge 20. The second cavity portion 34 can be disposed along the initiation axis 36 between the first cavity portion 32 and the third cavity portion 40. If desired, the third cavity portion 40 can be disposed concentrically about the initiation axis 36 and can be smaller in diameter than the second cavity portion 34 such that a second annular shoulder 42 can be formed on the housing 12 where the second and third cavity portions 34 and 40 intersect one another.

In the example provided, the housing 12 includes a housing member 50 and a cover 52 that are assembled to one another, but it will be appreciated that the housing 12 could be unitarily and integrally formed as a single, discrete component. The housing member 50 can be a tubular structure having a first axial end 54 and a second axial end 56. A through-bore 58 can be formed through the housing member 50 that is sized to the diameter of the third cavity portion 40. A first counterbore 60 can be formed into the first axial end 54 of the housing member 50 and can form the first annular shoulder 38. A second counterbore 62 can be formed into the first annular shoulder 38 and can form the second annular shoulder 42. It will be appreciated that the first and second annular shoulders 38 and 42 are spaced apart from one another along the initiation axis 36. The through-bore 58 that forms the third cavity portion 40 can extend from the second annular shoulder 42 through the second axial end 56 of the housing member 50. Accordingly, it will be appreciated that the first cavity portion 32 can extend through the first axial end 54 of the housing member 50, while the third cavity portion 40 can extend through the second axial end 56 of the housing member 50.

The cover 52 can be fixedly coupled to the second axial end 56 of the housing member 50 to close an end of the cavity 30. In the example shown, the cover 52 is received into a third counterbore 66 that is formed into the second axial end 56 of the housing member 50. The third counterbore 66 defines a third annular shoulder 68 against which the cover 52 is abutted. Any desired means may be employed to fixedly couple the cover 52 to the housing member 50 to close an end of the cavity 30 on the second axial end 56 of the housing member 50. In the particular example provided, the cover 52 is laser welded to the housing member 50.

Figure 5:
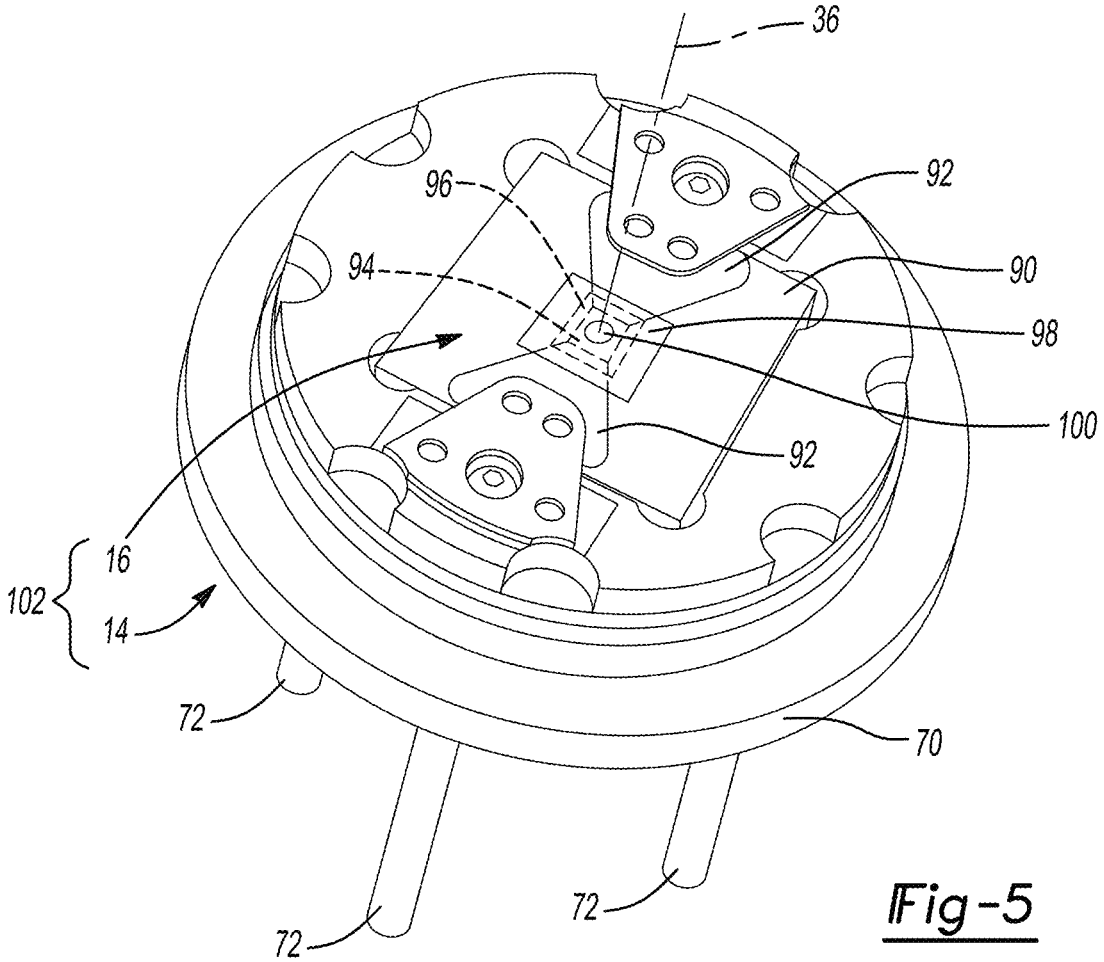
FIG. 5 is a perspective view of a portion of the initiator assembly of FIG. 1, illustrating a base and an exploding foil initiator in more detail.

With reference to FIGS. 4 and 5, the base 14 can be a structure or assembly to which the exploding foil initiator 16 can be mechanically and electrically mounted and which can secure the exploding foil initiator 16 to the housing 12. One example of a suitable base is the header that is illustrated and described in commonly assigned U.S. Pat. No. 7,571,679, the disclosure of which is incorporated by reference as if fully set forth in detail herein to the extent that they do not contradict any of the present disclosure. In brief, the base 14 can include a header body 70, a plurality of terminals 72 and a plurality of seal members 74. The header body 70 can define a plurality of terminal apertures 76. Each of the terminals 72 can be disposed through an associated one of the terminal apertures 76. Each of the seal members 74 can be received in an associated one of the terminal apertures 76 and can be sealingly engaged to the header body 70 and to a respective one of the terminals 72. If desired, other elements of the header assembly described in U.S. Pat. No. 7,571,679, such as an insulating spacer and a frame member, may be incorporated into the base 14 if desired. At least a portion of the header body 70 can be sized to be received into the first cavity portion 32 of the housing 12. In the example provided, the header body 70 is shaped as a right cylindrical plinth, having an outer diameter that is sized to fit into the first counterbore 60. The height of the header body 70 is relatively shorter than the distance between the first axial end 54 of the housing member 50 and the first annular shoulder 38.

The exploding foil initiator 16 can include a foundation structure 90, a pair of bridge contacts 92, a bridge 94, a flyer layer 96 and a barrel 98. The foundation structure 90 can be formed of any desired electrically insulating material, such as a ceramic material and/or a resin-impregnated fiberglass material. The bridge contacts 92 and the bridge 94 can be mounted onto the foundation structure 90 in a desired manner, such as via vapor deposition in one or more layers. The flyer layer 96 can be disposed over the bridge contacts 92, the bridge 94 and the foundation structure 90 and can be formed of a suitable material, such as a layer of polyamide. The barrel 98 can be disposed over and abut the flyer layer 96 and can be formed of a suitable material, such as a layer of polyamide. The barrel 98 can define a barrel aperture 100 that can extend fully through the barrel 98 and can be disposed concentrically about the initiation axis 36. The exploding foil initiator 16 can be mounted to the base 14 and each of the bridge contacts 92 can be electrically coupled to an associated one of the terminals 72. The base 14 and the exploding foil initiator 16, together with exploding foil initiator 16 can form a base/EFI assembly 102 that is received at least partly into the first cavity portion 32 of the housing 12.

Figure 6:
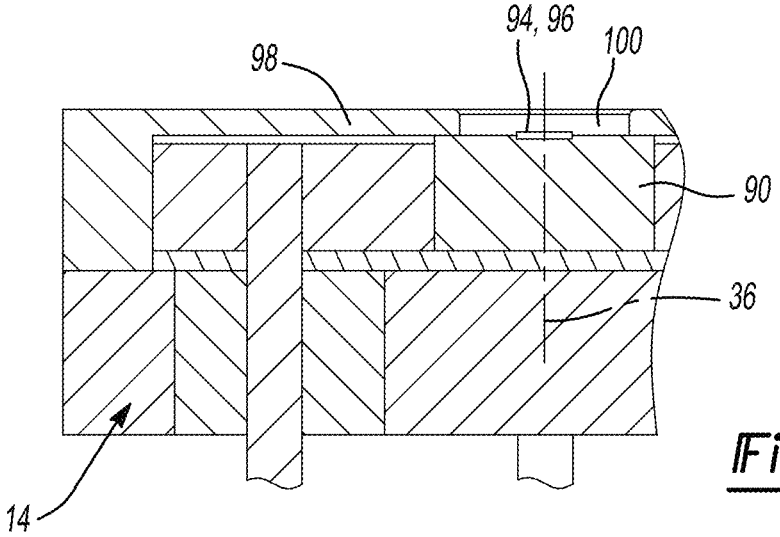
FIG. 6 is a section view of a portion of an alternately constructed exploding foil initiator.

As shown in FIG. 6, the barrel 98 could be overmolded onto the flyer layer 96 and the base 14. Configuration of an initiator assembly in this manner is described in more detail in commonly assigned U.S. Pat. No. 10,267,604 and commonly assigned U.S. Pat. Ser. No. 16/280,069, the disclosures of which are incorporated by reference as if fully set forth in detail herein to the extent that they do not contradict any of the present disclosure.

Returning to FIG. 4, the input charge assembly 18 includes a holder 110 and an input charge 112. The holder 110 is fixedly coupled to the housing member 50 and has a first holder portion 116 and an optional second holder portion 118. The first holder portion 116 is sized to be received into the second counterbore 62, while the second holder portion 118, if included, is sized to be received into the through-bore 58. In the example provided, the through-bore 58 is smaller in diameter than the second counterbore 62 so that the first holder portion 116 is relatively larger in diameter than the second holder portion 118. Accordingly, a fourth annular shoulder 120 is formed on the holder 110 where the first and second holder portions 118 and 116 intersection one another, with the fourth annular shoulder 120 extending radially outwardly from where the second holder portion 118 intersects the first holder portion 116. The holder 110 can define a charge aperture 122 that is disposed concentrically about the initiation axis 36 and which is configured to hold the input charge 112. The charge aperture 122 is formed into a first axial end 126 of the holder 110 and does not extend fully through the holder 110 in an axial direction along the initiation axis 36 (i.e., the charge aperture 122 does not extend through a second axial end 128 of the holder 110 that is opposite the first axial end 126 of the holder 110).

The input charge 112 is received into the charge aperture 122 and is formed of a suitable explosive material, such as a secondary explosive material. In the particular example provided, the input charge is formed of RSI-007 which is a secondary explosive material that is available from Reynolds Systems Incorporated of Middletown, California. Those of ordinary skill in the art will appreciate that the term "input charge" not only connotates that the element is formed of an energetic material, but also that this charge is the first charge (and possibly the only charge) in a line or string of charges that are operated when a "flyer" is discharged during operation of the exploding foil initiator 16. In this regard, a shockwave produced when the "flyer" impacts against another structure, such as the input charge 112 or a barrier/cover member 130, is transmitted into the input charge (i.e., either directly or indirectly) to cause the input charge 112 to detonate. Accordingly, it will be understood that the input charge 112 detonates in response to a shockwave that is produced through motion and impact of the "flyer" and not through in response to a shockwave produced by detonation of a charge of an energetic material.

Figure 7:
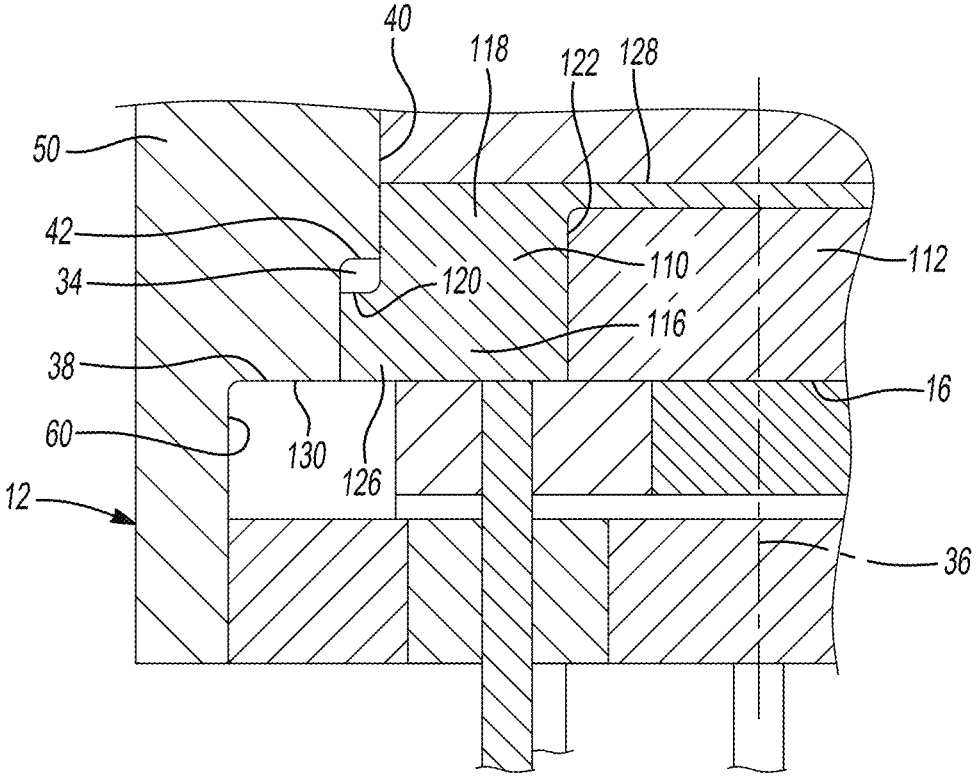
FIG. 7 is an enlarged portion of FIG. 4.

With reference to FIGS. 4 and 7, the first holder portion 116 is received into the second cavity portion 34 and located axially along the initiation axis 36 such that the fourth annular shoulder 120 is spaced apart from the second annular shoulder 42 on the housing member 50 and the second holder portion 118 is partly received in the third cavity portion 40 and partly received in the second cavity portion 34. It will be appreciated that orientation of the input charge 112 in this manner relative to the housing 12 positions the open end of the charge aperture 122 so that it faces the exploding foil initiator 16.

With reference to FIGS. 3 and 7, an optional barrier or closure member 130 may be received into the first counterbore 60 and abutted against the first axial end 126 of the holder 110 such that the input charge 112 is disposed between the closed end of the charge aperture 122 and the barrier or closure member 130. Alternatively, the barrier or closure member 130 can be received into the open end of the charge aperture 122, or mounted to the first axial end 126 of the holder 110 such that the input charge 112 is disposed between the closed end of the charge aperture 122 and the barrier or closure member 130. The barrier or closure member 130 could be employed for various reasons, including one or more of: a) electrically insulating the base/EFI assembly 102 from the holder 110 and/or the input charge 112; b) mechanically separating the base/EFI assembly 102 from the holder 110 and/or the input charge 112; c) sealing the input charge 112 within the charge aperture 122; and d) modifying (e.g., attenuating, amplifying, concentrating, spreading) the shockwave that is produced by the exploding foil initiator 16 prior to transmission of the shockwave into the input charge 112. In the example provided, the barrier or closure member 130 has a washer-like configuration having a center hole 132 that is disposed concentrically about the initiation axis 36 in-line with the barrel aperture 100 (FIG. 5). The center hole 132 can be sized in a desired manner but will generally be larger in diameter than the barrel aperture 100 (FIG. 5) so as not to impede the motion of a "flyer" that is produced when the exploding foil initiator 16 is operated. It will be appreciated, however, that the barrier or closure member 130 could be formed without the center hole 132, in which case the "flyer" produced when the exploding foil initiator 16 is operated is intended to impact against the barrier or closure member 130, rather than pass through the barrier or closure member 130.

With reference to FIG. 4, the output charge 20 is received in the third cavity portion 40 and is disposed along the initiation axis 26 between the housing 12 (i.e., the cover 52 in the example provided) and the second axial end 128 of the holder 110. The output charge 20 can be at least partly formed of an explosive material. In the example provided, the output charge 20 is formed of a secondary explosive material and is directly abutted against the cover 52 and the second axial end 128 of the holder 110.

With reference to FIGS. 3 through 5 and 7, when assembling the initiator assembly 10, the output charge 20 may be initially fitted into the housing member 50. In this regard, the output charge 20 may be compacted prior to its insertion into the housing member 50, and/or could be compacted in the housing member 50. If the output charge 20 is compacted prior to its insertion into the housing member 50, the output charge 20 could be fully compacted (i.e., to a desired density, to a desired volume, and to a desired size), or could be compacted to an intermediate level (e.g., to permit the output charge 20 to be received into the through-bore 58 in a slip-fit or press-fit manner) and thereafter fully compacted once it is received into the housing member 50. Depending upon manufacturing preferences, the cover 52 may be coupled to the housing member 50 prior to or after the output charge 20 has been assembled to the housing member 50.

Likewise, the input charge 112 can be fitted into the charge aperture 122 in the holder 110. The material that forms the input charge 112 may be compacted prior to its insertion into the holder 110, and/or could be compacted in the holder 110. If the input charge 112 is compacted prior to its insertion into the holder 110, the input charge 112 could be fully compacted (i.e., to a desired density, to a desired volume, and to a desired size), or could be compacted to an intermediate level (e.g., to permit the material that forms the input charge 112 to be received into the charge aperture 122 in a slip-fit or press-fit manner) and thereafter fully compacted once it is received into the holder 110. If a barrier or closure member 130 is employed in the initiator assembly 10 and is received into the open end of the charge aperture 122 and/or mounted to the holder 110, the barrier or closure member 130 can be inserted into the charge aperture 122 and/or mounted to the holder 110 as desired.

The input charge assembly 18 can be received into the housing 12 such that the second holder portion 118 is at least partly received into the through-bore 58 and the first holder portion 116 is received into the second counterbore 62. The input charge assembly 18 can abutted against the output charge 20 and can be secured to the housing 12 to inhibit movement of the holder 110 along the initiation axis 36. In the example provided, a force of a predetermined magnitude is applied to the holder 110 such that the second axial end 128 of the holder 110 is not only abutted against the output charge 20, but also the output charge 20 is in a force transmission path between the holder 110 and the housing 12. The holder 110 can be fixedly coupled to the housing 12, for example by laser welding the holder 110 to the housing 12, while the force of the predetermined magnitude is applied to the holder 110, the output charge 20 and the housing 12 to thereby ensure the absence of void space along the initiation axis 36 in the third cavity portion 40 that would potentially permit movement of the output charge 20, in whole or in part, along the initiation axis 36. Preferably, a compressive axial load is maintained on the output charge 20 along the initiation axis 36 after the holder 110 has been fixedly coupled to the housing 12. To ensure that a compressive load can be maintained on the output charge 20 after fixedly coupling the holder 110 to the housing 12, the spacing of the second annular shoulder 42 away from the first annular shoulder 38 along the initiation axis 36 is larger than the distance between the first axial end 126 of the holder 110 and the fourth annular shoulder 120, and the spacing between the second annular shoulder 42 and the cover 52 along the initiation axis 36 is smaller than the sum of the distance from the fourth annular shoulder 120 to the second axial end 128 of the holder 110 and the overall length of the output charge 20 along the initiation axis 36. The holder 110 may be coupled to the housing 12 at one or more discrete points, for example about the circumference of the first holder portion 116/second counterbore 62. Alternatively, the holder 110 may be coupled to the housing 12 around the entirety of the circumference of the first holder portion 116/second counterbore 62, which may effectively seal the first cavity portion 32 from the third cavity portion 40.

The base/EFI assembly 102 can be received into the housing 12 such that the base 14 is at least partly received into the first counterbore 60 and the base/EFI assembly 102 abutted against the input charge assembly 18 (or against the barrier/closure member 130 if one is employed in the initiator assembly 10). To the extent that a barrier or closure member 130 is employed and it is merely disposed between the input charge assembly 18 and the base/EFI assembly 102, then the barrier or closure member 130 can be received into the cavity 30 in the housing 12 prior to the insertion of the base/EFI assembly 102 into the housing 12. Once the base/EFI assembly 102 has been abutted to the input charge assembly 18 (if no barrier or closure member 130 is employed in the initiator assembly 10) or to the barrier or closure member 130 (if a barrier or a closure member is employed in the initiator assembly 10), the base 14 may be coupled to the housing 12 at one or more discrete points, for example about the circumference of the header body 70/first counterbore 60, to close the cavity 30 at a first axial end 54 of the housing member 50. Alternatively, the base 14 may be coupled to the housing 12 around the entirety of the circumference of the header body 70/first counterbore 60, which may effectively seal the first cavity portion 32 from the atmosphere.

Because neither the holder 110 nor the base 14 engage a hard stop formed on the housing 12, both the holder 110 and the base 14 are able to move along the initiation axis 36 during the assembly process to ensure that a compressive load of a predetermined magnitude is placed on the output charge 20, and to ensure that the base/EFI assembly 102 in general, and more specifically, the axial end of the barrel 98 of the exploding foil initiator 16 that is most distant from the bridge 94, is spaced relative to the input charge 112 or to the barrier or closure member 130 in a desired manner. Where the various components are welded together, for example, the cover 52 and the housing member 50, the holder 110 and the housing member 50 and/or the base 14 and the housing member 50, the configuration that is described above and illustrated in the drawings permits the formation of a butt weld between components (i.e., the welds between the cover 52 and the housing member 50, the holder 110 and the housing member 50, and the base 14 and the housing member 50 are butt welds in the example illustrated). Given the flexibility in the positioning of the holder 110 and the base 14 within the housing 12, it will be appreciated that the initiator assembly 10 can be designed such that the first axial end 54 of the housing member 50 is flush with an outer axial end of the base 14 and that the first axial end 126 of the holder 110 can be flush with the second annular shoulder 42, but that the outer axial end of the base 14 could be recessed below or protrude from the first axial end 54 of the housing member 50 and/or the first axial end 126 of the holder 110 could be recessed into the second counterbore 62 or extend into the first counterbore 60.

In operation, an electrical signal of a predetermined voltage can be applied to one of the terminals 72 to drive electrical current through the bridge 94 to cause the bridge 94 to suddenly convert from a solid into a plasma. The conversion of the material of the bridge 94 into a plasma is associated with a large change in volume that causes a "flyer" to shear from the flyer layer and propel the "flyer" through the barrel 98. Despite the fact that the "flyer" is relatively thin and can be formed from a material such as polyamide, the "flyer" exits the barrel 98 with sufficient energy to generate a shockwave when it impacts the barrier or cover member 130 (if a solid barrier or cover member is present in the initiator assembly 10) or an axial end of the input charge 112 that faces toward the exploding foil initiator 16 (in situations where no barrier or cover member 130 are present in the initiator assembly 10 or when the barrier or cover member 130 is configured to permit the "flyer" to pass through it an impact against the input charge 112). The shockwave is sufficiently strong so that it migrates into the input charge 112, either directly or through the barrier or cover member 130 (if a solid barrier or cover member 130 is present in the initiator assembly 10) to cause the material of the input charge 112 to detonate. Energy produced by the detonation of the material of the input charge 112 can be employed to generate a second, more powerful shockwave that can be employed to rupture the closed end of the holder 110 and initiate detonation of the material that forms the output charge 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An initiator assembly comprising:

a housing defining a cavity;

a base coupled to the housing and closing the cavity;

an exploding foil initiator mounted to the base, the exploding foil initiator having a barrel that defines an initiation axis;

an input charge assembly received in the cavity, the input charge assembly having a holder and an input charge, the holder having a first axial end and a second axial end that are spaced apart along the initiation axis, the first axial end being closer to an output of the barrel than the second axial end, wherein a charge aperture is formed through the first axial end of the holder and does not extend through the second axial end of the holder, the input charge being formed of an explosive material and received into the charge aperture.

2. The initiator assembly of claim 1, wherein the explosive material is a secondary explosive.

3. The initiator assembly of claim 1, wherein the cavity in the housing has a first cavity portion and a second cavity portion, wherein the first cavity portion is larger in diameter than the second cavity portion, wherein a first annular shoulder is formed on the housing where the first and second cavity portions of the cavity intersect one another, wherein the holder has a first holder portion and a second holder portion, wherein the first holder portion is larger in diameter than the second holder portion, wherein a second annular shoulder is formed on the holder where the first holder portion intersects the second holder portion, wherein the second holder portion is at least partly received in the second cavity portion, and wherein the first holder portion is received in the first cavity portion.

4. The initiator assembly of claim 3, wherein the first and second annular shoulders are spaced apart from one another along the initiation axis.

5. The initiator assembly of claim 4, wherein the cavity in the housing has a third cavity portion, wherein the first cavity portion is disposed along the initiation axis between the second and third cavity portions, wherein the third cavity portion is larger in diameter than the first cavity portion, wherein a third annular shoulder is formed on the housing where the first and third cavity portions intersect one another, wherein the base is received into the third cavity portion.

6. The initiator assembly of claim 5, wherein a butt weld is disposed about the second holder portion that secures the second holder portion to the housing.

7. The initiator assembly of claim 6, wherein the first axial end of the holder is flush with the second annular shoulder on the housing.

8. The initiator assembly of claim 5, wherein an axial end of the base is flush with an axial end of the housing.

9. The initiator assembly of claim 5, wherein a butt weld is disposed about the base that secures the base to the housing.

10. The initiator assembly of claim 1, further comprising an output charge received in the cavity and disposed on a side of the holder that is opposite the input charge.

11. An initiator assembly comprising:

a housing having a housing member and a cover, the housing member having a first axial end and a second axial end, the housing member defining a cavity with a first cavity portion, a second cavity portion and a third cavity portion, the first cavity portion extending through the first axial end of the housing member, the third cavity portion extending through the second axial end of the housing member, the second cavity portion being disposed between the first and third cavity portions, the first cavity being larger in diameter than the second cavity portion so as to define a first annular shoulder on the housing member where the first and second cavity portions intersect one another, the second cavity portion being larger in diameter than the third cavity portion so as to define a second annular shoulder on the housing member where the second and third cavity portions intersect one another, the cover being fixedly coupled to the second axial end of the housing member to close an end of the cavity;

an output charge received in the third cavity portion, the output charge being at least partly formed of an explosive material;

an input charge assembly having a holder and an input charge, the holder being fixedly coupled to the housing member and having a first holder portion and a second holder portion, the first holder portion defining a charge aperture that does not extend fully through the holder, the second holder portion being smaller in diameter than the first holder portion, wherein a third annular shoulder is formed on the holder radially outwardly of where the second holder portion intersects the first holder portion, the first holder portion being received into the second cavity portion and located such that the third annular shoulder is spaced apart from the second annular shoulder on the housing member, the second holder portion being partly received in the third cavity portion, the input charge being received into the charge aperture and being formed of an explosive material;

a base/EFI assembly having a base, a plurality of terminals, and an exploding foil initiator, the base being fixedly coupled to the housing member, the terminals extending through the base and being electrically coupled to the exploding foil initiator, the exploding foil initiator being coupled to the base, the base/EFI assembly being slidably received into the first cavity portion and closing the cavity on a side of the housing member opposite the cover, wherein the base/EFI assembly is abutted against either an axial end of the holder or a barrier that is abutted against the axial end of the holder.

* * * * *